US005787523A

United States Patent [19]

Lindberg

[11] Patent Number: 5,787,523

[45] Date of Patent: Aug. 4, 1998

[54] PATIENT SLIDING SHEET WITH LIQUID ABSORBING LAYER

[76] Inventor: Eva Lindberg, Vetlandavägen 6 S-575 38, Ekajö, Sweden

[21] Appl. No.: 793,674

[22] PCT Filed: Sep. 1, 1995

[86] PCT No.: PCT/SE95/00988

§ 371 Date: Feb. 27, 1997

§ 102(e) Date: Feb. 27, 1997

[87] PCT Pub. No.: WO96/06550

PCT Pub. Date: Mar. 7, 1996

[30] Foreign Application Priority Data

Sep. 1, 1994 [SE] Sweden ..... 9402900
Jun. 22, 1995 [SE] Sweden ..... 9502268

[51] Int. Cl.[6] ..... A61G 12/00; A61G 7/10

[52] U.S. Cl. ..... 5/81.1 HS; 5/81.1 T; 5/490; 5/496; 5/484; 5/925; 5/926

[58] Field of Search ..... 5/81.1 T, 81.1 HS, 5/925, 926, 482, 484, 496, 498, 490

[56] References Cited

U.S. PATENT DOCUMENTS

| | | | |
|---|---|---|---|
| 1,334,901 | 3/1920 | Higdon | 5/81.1 T |
| 2,660,735 | 12/1953 | Baum | 5/484 |
| 2,779,035 | 1/1957 | McMurry | 5/484 |
| 3,849,813 | 11/1974 | Neilson | 5/81.1 T |
| 4,064,577 | 12/1977 | Walters | 5/484 |
| 4,675,925 | 6/1987 | Littleton | 5/484 |
| 5,092,008 | 3/1992 | Okubo | 5/484 |
| 5,329,655 | 7/1994 | Garner | 5/926 |

FOREIGN PATENT DOCUMENTS

| | | | |
|---|---|---|---|
| 159642B | 5/1985 | Denmark . | |
| 8405630 | 11/1984 | Sweden . | |
| 733980 | 7/1955 | United Kingdom | 5/498 |
| 2 235 132 | 2/1991 | United Kingdom . | |

*Primary Examiner*—Alexander Grosz
*Attorney, Agent, or Firm*—Fasth Law Firm; Rolf Fasth

[57] ABSTRACT

The invention pertains to a low friction bed sheet or the like for facilitating changing the position of a person or part of a person in prone position. The low friction bed sheet includes at least a low friction surface comprising a material with low friction and adjacent to the low friction surface are high friction surfaces comprising materials with high friction. The low friction surface is placed only on the side against the person in bed while the underside against the bed is mainly comprised of at least one high friction surface. The width of the low friction surface is less than the width of the bedding for which the low friction bed sheet is intended. In the transition between the low friction surface and the high friction surface there are transition zones at least lengthwise in the bed which can be perceived by the person in the bed.

17 Claims, 5 Drawing Sheets

PATIENT SLIDING SHEET WITH LIQUID ABSORBING LAYER

The present invention concerns a low friction bed sheet or the like to facilitate changing the position of a person or part of the person's body in a prone position and including at least a low friction surface (1) made of substantially frictionless material and a bordering high friction surface (2) of high friction material.

BACKGROUND OF THE INVENTION

It is well known that it can be very difficult for people with physical handicaps of different types to turn over in bed. This increases their suffering considerably. Examples of these types of people are those with permanent of temporary partial paralysis, people with different types of injuries, for example back injuries, people that have recently been operated on, etc. Today there is no good commercial aid to help people with these motor problems turn themselves over in bed.

In U.S. Pat. No. 3,849,813 a "draw sheet" is described, that is a sheet that is put under a person to help a carer turn the person in bed by pulling the "draw sheet" toward himself/herself. It includes a central inner part of an essentially frictionless material which has been attached to a normal sheet. This has been done to make it possible for the user who lies on the sheet to glide easily while his/her extremities, which are in contact with the normal sheet material, can achieve the change in body position.

The problem with the above draw sheet is that no account has been taken of the fact that the person in question can slip out of the bed, as attention has only been paid to assuring the position of the draw sheet's low friction part on the bed through sufficiently long side parts which are tucked in under the mattress. Another problem is the proposed material for the low friction part, which is either easily damaged when wet (for example rayon) or cannot be washed at sufficiently high temperatures, at least 70° C. (for instance acetate), which is a requirement on bed and textile materials in hospitals.

There is another aid known as "Ross Glidmatta" which is sold in different sizes. The low friction mat is primarily an aid for carers to help them move or turn a physically handicapped or newly operated person in a mild way. The low friction mat is often used in combination with a normal draw sheet.

If a physically handicapped person uses the low friction mat above to help turn himself/herself in bed the low friction mat is clearly dangerous, especially when the person is to get into or out of the bed because high friction surfaces are absent. The low friction mat is also made of thick padded material which can seem clumsy and warm to lie on. For the above reasons the low friction mat is unsuitable for long term use in beds for physically handicapped persons.

In SE patent 8405630-8 the slipperiness problem has been observed, but the low friction bed sheets that are presented still have such important problems that in practice they cannot be used. In the choice of low friction material for the slippery part only friction and not washability, comfort or the risk of bedsores has been taken into account (silk or plastic are quite inappropriate). Because both surfaces of the low friction bed sheet have slippery surfaces, it can easily slip to the side when the patient lies on the bed or gets up from it.

Other often occurring problems for bedridden persons with physical handicaps or sicknesses are incontinence and the risk of bedsores. Modern hospital care, handicap care and elderly care lack a complete aid which facilitates position changes in bed in a safe manner from the point of view of accident risk and which at the same time functions as an incontinence protection and reduces the risk of bedsores.

THE PURPOSE OF THE INVENTION AND THE SOLUTION OF THE PROBLEM

The purpose of the present invention is to provide a low friction bed sheet of the type mentioned in the beginning which facilitates changing the position of a bedridden person, that is turning himself/herself over or changing his/her position in bed and gives the bedridden person an indication of when he/she nears the side of the bed and thus prevents him/her from slipping out of the bed. It should be used in combination with draw sheets and thus simplify and facilitate a carer's moving and turning a patient in bed. It should be made of a material that can be washed at such high temperatures that hospital hygiene requirements can be met, or alternatively it should be made of inexpensive disposable material which can also be used by incontinence patients or those that have difficulties with pressure or bedsores. It can also be used as a pillow case for patients with head, neck or back problems. These problems have been solved by the characteristics given in the patent claims.

DESCRIPTION OF THE DRAWINGS

In the following the invention will be described in a number of exemplifications with reference to the drawings.

DESCRIPTION OF THE EXEMPLIFICATIONS

Figure 1:
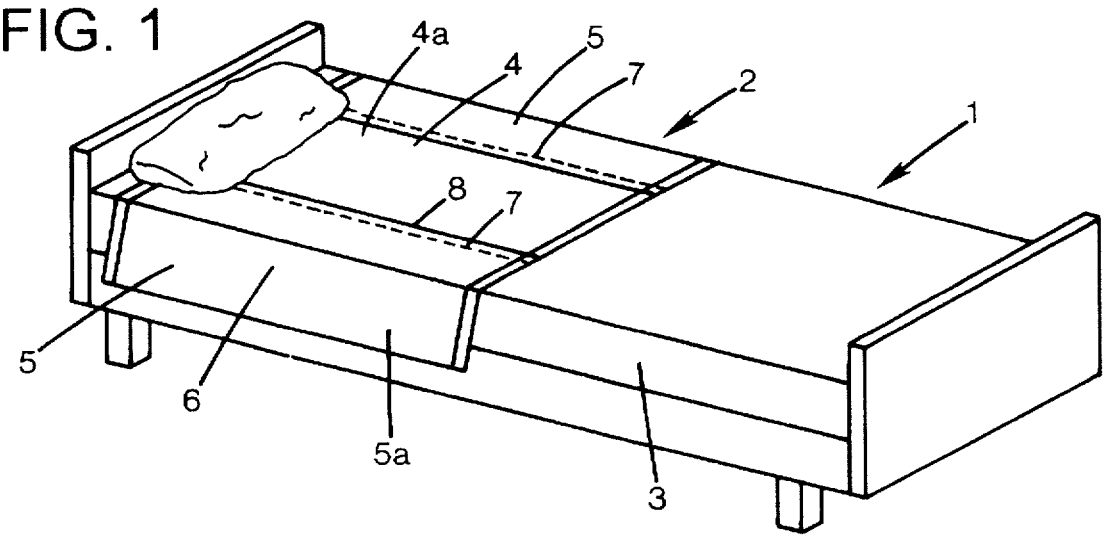
FIG. 1 shows a perspective of a bed with a low friction bed sheet according to the invention.
Figure 2:
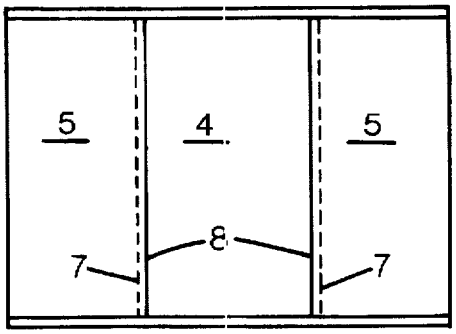
FIG. 2 shows the low friction bed sheet according to FIG. 1 in a top view.

FIG. 1 shows a bed 1 schematically with a low friction bed sheet 2 according to the invention in the form of a so-called upper sheet placed on top of the bed and where it hangs free at the sides, as illustrated in FIG. 1, or where the corners of the sheet are tucked in under for example a mattress 3.

The low friction sheet 2 includes a low friction surface 4 flanked on two sides by a high friction surface 5. The low friction surface 4, which in this exemplification is a low friction material 4*a*, has been equipped with a high friction surface on its back side, for example in the form of a part of a sheet, which low friction material has been sewn with hems 7 together with the high friction surfaces 5, which are also appropriately made of sheet cloth. The seams thus form two transition zones in the form of small raised parts that can be sensed by the person in bed and which function as stops minimising the risk of the person sliping out of the bed. Alternatively the said raised parts—the stops—can be made of for example a tape or the like sewn on or otherwise fastened to the low friction bed sheet.

The expression "low friction bed sheet" is taken to mean any type of bedding between the mattress and the coverlet on which the person lies, that is, except for the bedspread including also covering sheets, quilt covers covering the whole mattress, pillow cases and other wholly or partially covering cases for support pillows.

According to a special variation of the low friction bed sheet the low friction material is much longer than shown in FIG. 1, for example 150 cm–160 cm, and is intended for totally paralysed or nearly totally paralysed persons in need of a low friction surface also under their legs and feet. Use of such an "extended" low friction bed sheet makes it easier for carers to turn and move the patient. Another possibility is to make an "extended" low friction bed sheet by using two low friction bed sheets with low friction material of normal length (about 1 m) and to place them parallel and overlapping on the beds.

Figure 4:
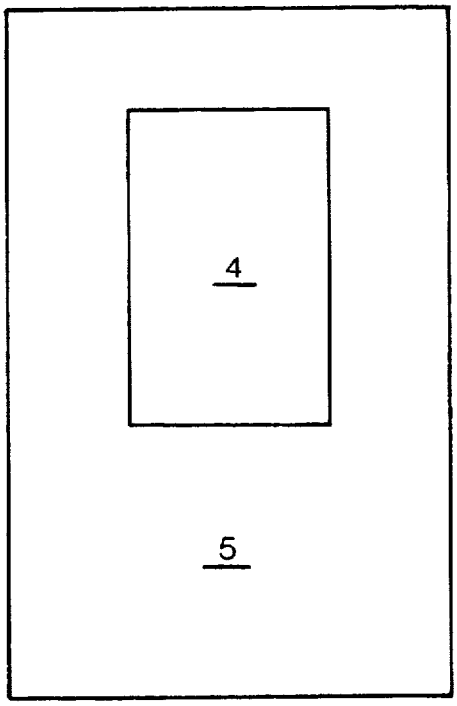
FIG. 3–9 show all variants of the low friction bed sheet in top views.
Figure 3:
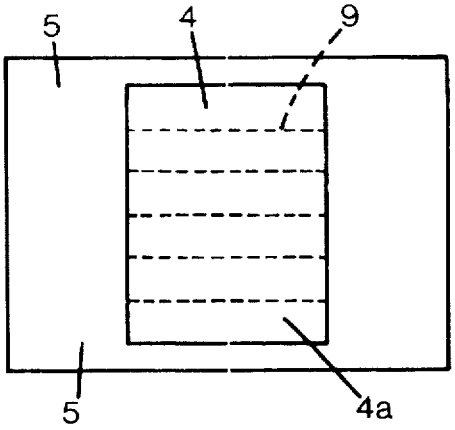
Figure 5:
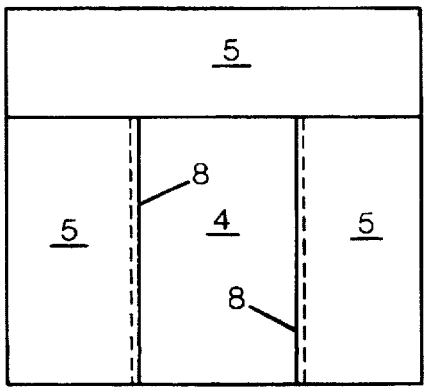
Figure 6:
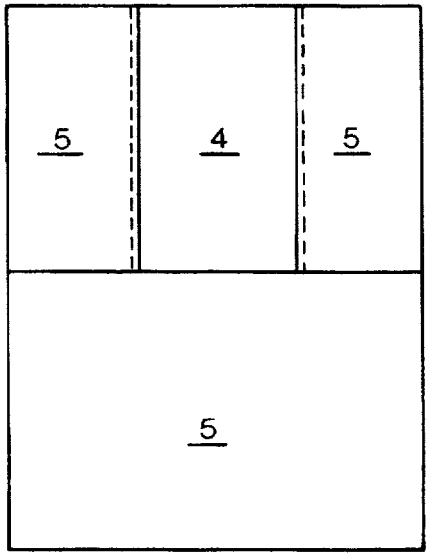
Figure 7:
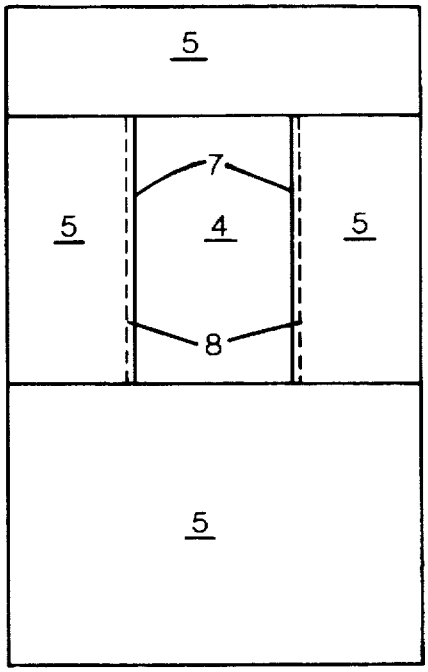
Figure 9:
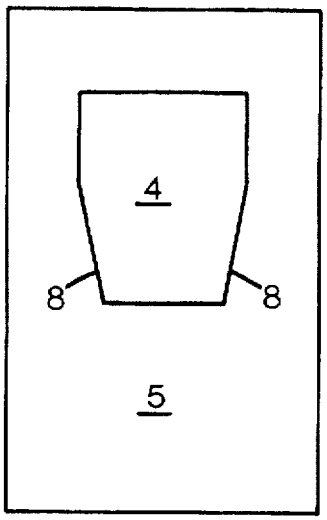

FIG. 3, 4 and 9 each show a low friction bed sheet schematically where the low friction material has been applied symmetrically on a whole piece of a friction material 5*a*, for example a sheet cloth. The application can be realised by sewing or other appropriate means, for example using glue, buttons or fastening of the type known as Velcro.

A special variant of the low friction bed sheet according to FIG. 3 has an number of extra seams 9 in the slide direction of the low friction bed sheet, that is sideways, to better hold the low friction material in place against the material below it. The low friction surface 4 can take any form at all but is appropriately rectangular or hexagonal, as in FIG. 9.

Figure 23:
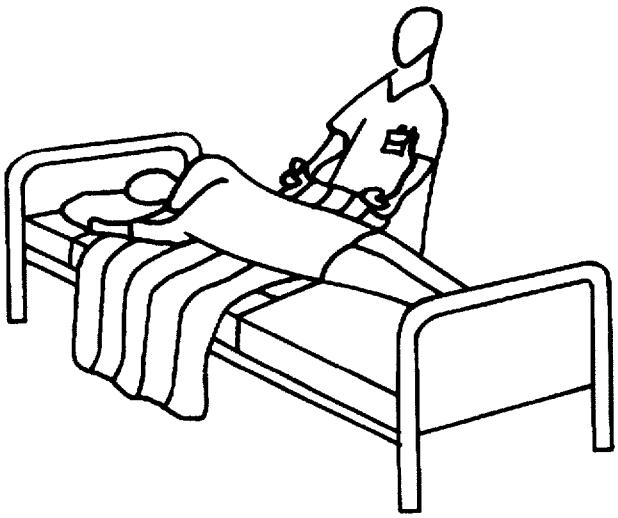

The low friction material must have at least as much adhesion on its underside as a conventional cotton sheet for the low friction bed sheet to maintain its intended position on the bedding. To avoid letting the possibly more slippery upper side of the low friction material coming into contact with the bedding, for example at the seams, the hems are on the upper side, that is, they are wrong way up. To avoid the risk of slipping the hems can even be made in a different way, for example in a zigzag seam or using taping. Paying attention to such details is important concerning the upper sheet because it should be possible to use them even without tucking the corners in under the mattress which otherwise reduces the risk that the low friction bed sheet change its position. These security measures are especially important when draw sheets are used over the low friction bed sheet according to FIG. 23.

The width of the low friction material must be adjusted to the width of the bed for which the low friction bed sheet is intended. The width can also be adapted to the user so that a heavy, wide person has a somewhat wider low friction material than is the case for a thin person. As a guide-line the low friction material should be 20–30 cm narrower (at its widest part when the low friction material is not rectangular) than the bed on which the low friction bed sheet is to be used. Thus, for a bed 90 cm wide a typical low friction material width is 50–70 cm, optimal being 65 cm. For a 120 cm wide bed wider friction borders are possible, for example 30–60 cm. For safety it is extremely important that the bed width for which the low friction bed sheet is intended is clearly marked on the bed sheet (for example using wash proof marking) as well as on the packing material when selling it.

Figure 8:
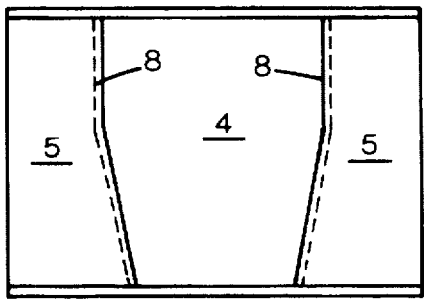

The length of the low friction material can vary. For the low friction bed sheets according to FIG. 1 and 8 the length is essentially the same as the low friction bed sheet's length but in the other figures the length of the low friction material is less than the total length of the low friction bed sheet. To a certain extent the length of the low friction material should be adjusted to the height of the user but this is not as critical as in the case of the width. For the user to have optimal freedom of movement in the bed the trunk and bottom should lie on the low friction material while the lower legs should lie wholly on the high friction material. A typical length of the low friction material is 90 cm–115 cm when it is intended for a grown person. Another typical length, specially adjusted for total paralytics, can be 150–160 cm.

The textile material of which the low friction bed sheet is made and which can be either natural or synthetic or a combination of both must be washable at bacteria killing temperatures, for example over 70° C., without losing its structure or shrinking. This applies to the low friction material as well as the high friction material and possible other material. Appropriate materials are for the low friction material polyester and for the high friction material a cotton-synthetic mixture containing 0–70% cotton. The high friction material can be woven or knitted tricot, for example terry cloth.

Figure 18:
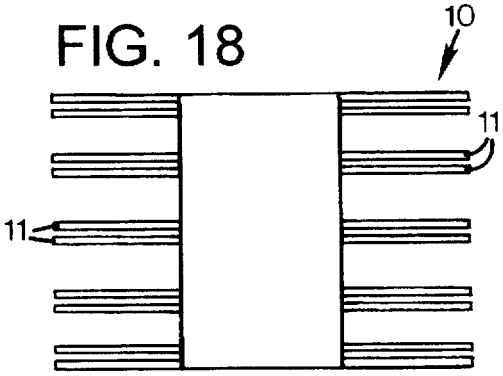
FIG. 18 shows a low friction bed sheet with a tape for fixing its position in a top view.

Further increased safety when it comes to reducing the risk of slipping out of the bed when using the low friction bed sheet according to the invention can be achieved when the low friction or high friction material's edges are equipped with position fixing fasteners 10 to be fastened to for example the mattress or the bed or to be coupled together under the mattress. The fasteners 10 can be of sewn on tape 11 as shown in FIG. 18, double sided tape, Velcro or also an elastic along the edges of the bed sheet which hold the low friction bed sheet against the mattress's sides. An alternative way to achieve the said improved safety is to make the high friction material extra wide so that the lengthwise end parts can overlap under the mattress whereby either the said fasteners fix them or the weight of the person in bed prevents the low friction bed sheet from changing positon.

The low friction bed sheet 2 also functions very well in combination with a normal draw sheet whereby the draw sheet is placed conventionally over the low friction bed sheet. The purpose is to further facilitate the carers' turning bedridden physically handicapped people lying on the draw sheet. When the carer pulls the draw sheet from one side of the bed it slides easily on the low friction bed sheet and the person on top is turned without great effort on the part of the carer (see FIG. 23). The reason is that the friction between the draw sheet and the low friction sheet is considerably less than when a draw sheet is used in the conventional manner on top of a normal sheet. Also in this application the risk of accidents is minimised because of the low friction bed sheet's side parts with high friction.

Instead of using a draw sheet when a patient is to be turned in bed the low friction bed sheet can be used. For that purpose grip like pieces can be attached to the transition between the low friction surface and the high friction surface or directly on the high friction material. The grip like pieces make it possible for a carer to lift up that part of the sheet that is positioned under the patient and roll him/her over to the other side. The grip like pieces (not shown) can be sewn cloth pockets of a strong material, folds sewn into the high friction material, tape or the like which does not disturb the person in bed and which also fulfils the requirements of washability.

Figure 15:
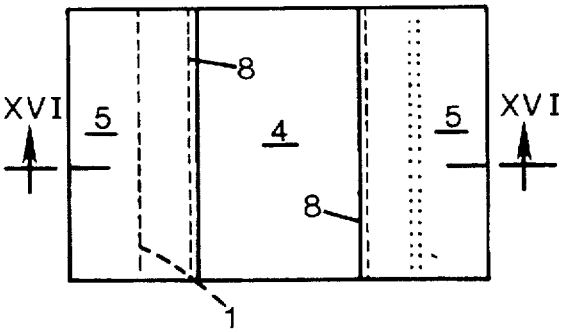
FIG. 15 shows a low friction bed sheet with detachable incontinence protection in a top view.
Figure 16:
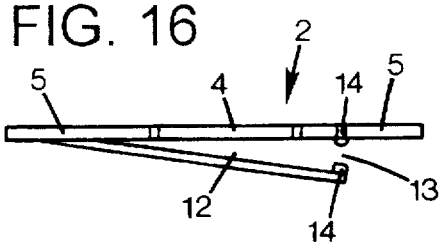
FIG. 16 shows a section along the line XVI—XVI in FIG. 15.

A special variant of the low friction bed sheet is shown in FIG. 15 where on its underside the sheet has been equipped with a pocket 12 with an opening 13 in some direction made of a material which at least on its underside has high friction. In the pocket 12, the opening of which may be closed using for instance Velcro 14, an incontinence layer 15 and/or a pressure relieving layer 16 is insertable. The upper side of the pocket consists of a low friction material and its underside of a normal friction sheet material, plastic, plasticised terry cloth or rubberised material or the like. The pocket can have variable width but is optimally somewhat wider than the low friction material and can be applied in different alternative manners, for instance sewn on with seams along one, two or three sides or attached with Velcro or with semi-fixing glue material in a corresponding way. FIG. 15 and 16 show the case when one edge of the pocket is affixed by a seam in the lengthwise direction and the other edge by a Velcro band 14 while the upper and lower edges are not affixed.

Figure 17:
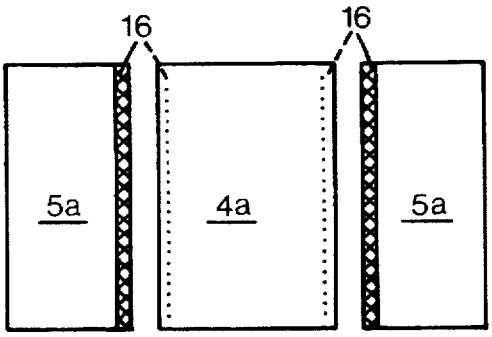
FIG. 17 shows a low friction bed sheet consisting of several parts.

In a variant of the low friction bed sheet 2, shown in FIG. 17, the low friction material 4*a* is primarily intended for one time use and is applied appropriately on the high friction material using for example some type of semi-fixing material as for instance Velcro or appropriate glue. The parts that are used more than once can be specially made of high friction parts. The material of the high friction parts can be paper, plasticised paper, non woven, paper fiber pulp, fluffy pulp, foam rubber, tape or similar material which is used today for disposable incontinence protection, disposable diapers and tampons.

Alternatively the disposable low friction material be shaped to be fastened, for example by gluing, directly on a normal undersheet or otherwise be made so that the low friction material is held in position and stays still due to its own weight or through rubberising its underside or by other means.

Figure 19:
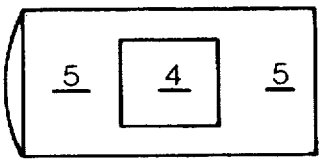
FIG. 19 shows a pillow case with low friction surface according to the invention in perspective.

A variant of the low friction bed sheet in the form of a pillow case or pillow cover is shown in FIG. 19. In the same way as the low friction bed sheet it is equipped with a low friction surface 4 or a low friction material 4*a* which is adjusted to the width of the pillow so that it is covered on two or four sides by high friction surfaces 5, for example high friction material 5*a*. The low friction material can also be applied to a pillow case of high friction material in a way corresponding to that described above in connection with the low friction bed sheet 2. The low friction pillow case is intended for use by physically handicapped where the damage is localised to the head or neck, for instance after whip lash accidents, vertebra fractures, skull fractures, etc. When using the low friction pillow case the handicapped person lies with the back part of the head directly on the pillow case low friction surface and with the neck against the lower part of the pillow case which is without low friction material and thus more comfortable in its contact with the neck skin.

The low friction pillow case functions also in combination with the main draw sheet whereby it is placed on top of the low friction pillow case. The purpose is to facilitate the carers' treatment of the patient on turning or moving the head.

According to a modification of the low friction bed sheet or pillow case the low friction surface 4 is woven into a high friction sheet material by using for instance the Jacquard method or a similar method. The low friction bed sheet is made in one piece by simultaneous weaving of warp thread with low friction (for instance polyester) and warp thread with high friction (for example cotton) in such a way that a low friction surface 4 which is slippery in the sideways direction is placed as a middle piece in the same position and shape as described above and parts with high friction are placed on two or four sides of the low friction surface. The transition zones 8 between the low friction and high friction surfaces and also the side parts can possibly be made by "double weaving" to make a slip stop edge corresponding to the overlapping hem 7 according to FIG. 1. A further potential of this production method is that the transition zones 8 can be made of special high friction warp thread on the upper or lower side as desired.

The different surfaces 4 and 5 of the low friction bed sheet can also be made by coating a cotton sheet, a non-woven sheet or the like with layers with different surface characteristics. Slippery surface layers where a low friction surface is desired and high friction layers where high friction surfaces are desired can be made. A plastic layer of appropriate type, for example PVC, polyurethane or acrylic can possibly be components of an integrated part of the low friction bed sheet which then makes up a single unit fulfilling several functions. Further, the plastic layer can be of the type that "breathes", that is, allows air but not liquid to pass through it. Also absorbing layers woven in the sheet are possible.

Figure 20:
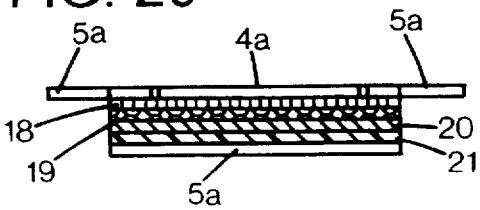
FIG. 20 shows a section through a low friction bed sheet with incontinence protection and pressure relief.

The various illustrated embodiments of the low friction bed sheet 2 of the present invention may advantageously be integrated with the incontinence protection layer 15 or the pressure relief layer 16 or a combination of the protection layer 15 and the pressure relief layer 16. The incontinence protection and the pressure relief mechanism may then be applied as different layers on the under side of the low friction bed sheet. FIG. 20 shows a section of such an integrated sheet. The integrated sheet includes a low friction layer 4*a* with the adjacent high friction layers 5*a*. A liquid transporting layer 18 may be disposed below the layers 4*a* and 5*a*. The layer 18 may be made of, for example, a woven synthetic cloth having channels defined therein. A pressure relief layer 19 may be disposed below the layer 18. The layer 19 may be made of a foam rubber, connected rubber rods or a wad material. A liquid absorbing layer 20 may be disposed below the layer 19 and be made of a towel material or a similar material. A moisture barrier layer 21 may be disposed below the layer 20 and be made of a plastic, a thin plastic laminate, a towel material that is coated with a plastic or a similar material. A high friction layer 5*a* may be disposed below the layer 21 that includes a sheeting material made of a towel, cloth, plastic, rubber or a similar material. The different layers may be attached to one another by stitches, preferably in the sliding direction of the low friction surface. The moisture barrier layer 21 and possibly the high friction layer 5*a* may only require to be attached at the edges (for example with an edge tape) to function as water proof barriers. Alternatively, the layer 21 and/or layer 5*a* may be separate units that are placed loosely under the low friction bed sheet. The layers 21 and 5*a* may also be attached to the low friction bed sheet with a Velcro tape, double side tape or the like.

Of course it is also possible to combine pieces of disposable material with material that can be used several times.

Figure 12:
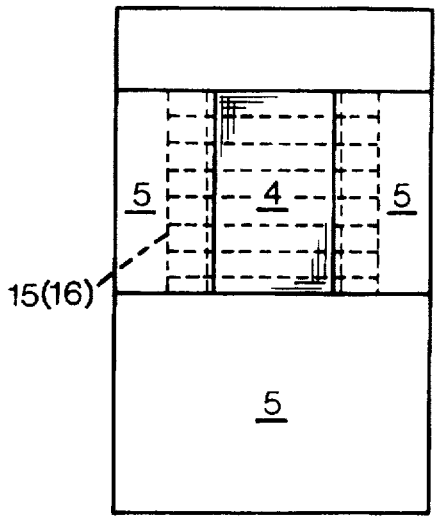
FIG. 12 shows a modification of the low friction bed sheet according to FIG. 11.
Figure 11:
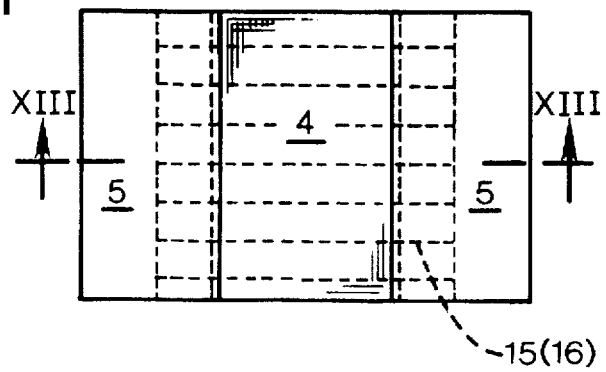
FIG. 11 shows the combined low friction bed sheet-incontinence protection according to FIG. 10 in top view.
Figure 10:
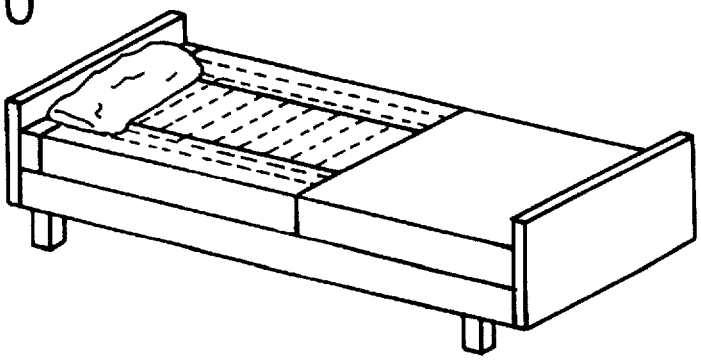
FIG. 10 shows a view analogous to FIG. 1 of a low friction bed sheet with incontinence protection.
Figure 13:
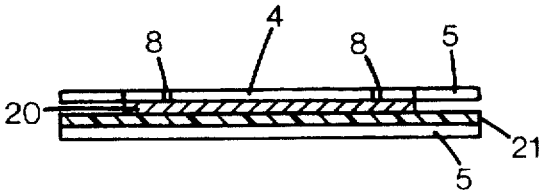
FIG. 13 shows a section along the line XIII—XIII in FIG. 11.
Figure 14:
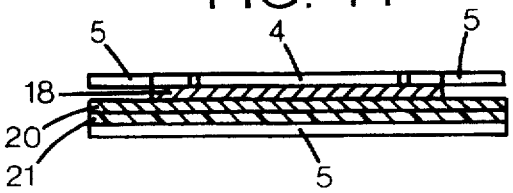
FIG. 14 shows a section through another exemplifications of a low friction bed sheet with incontinence protection.

The width of the incontinence protection 15 and/or the pressure relief layer 19 should be adjusted to the bed for which the low friction bed sheet is intended. These layers should be somewhat wider than the low friction surface according to FIG. 11 and 12 and appropriately should have the same width as the bed. The lengths of these layers can vary but should be the same as the length of the low friction surface. The different layers can be combined with the low friction bed sheet's low friction surface 2 and high friction surfaces 5 in different ways as needs be. In long term and elderly care, where severe incontinence and pressure sore risk are common, the low friction bed sheet can advantageously be used combined with all the layers. The total thickness of the low friction bed sheet with all the layers is about 1–2 cm.

Figure 21:
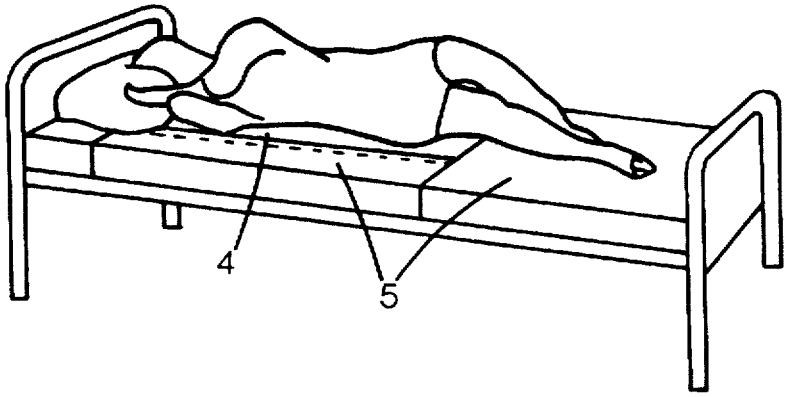
FIG. 21–23 show three different ways of using the low friction bed sheet according to the invention in perspective.

The low friction bed sheet can mainly be used in the following ways:

1. The user lies directly on the low friction bed sheet's low friction surface 4. Reduced friction makes it significantly easier to change position in the bed by oneself, see FIG. 21.

Figure 22:
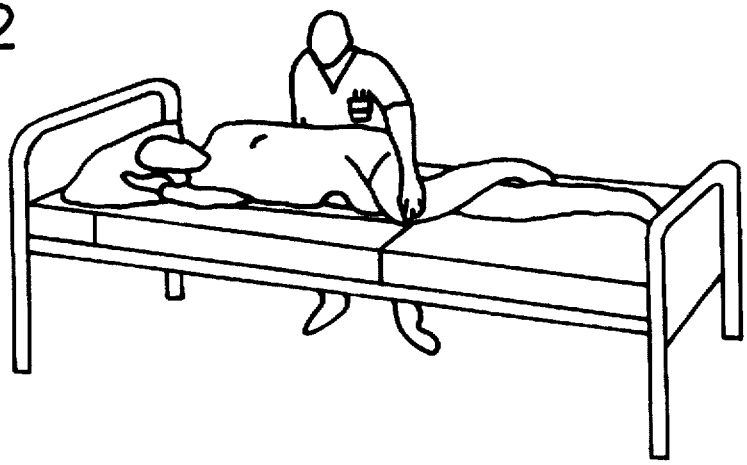

2. The user lies directly on the low friction bed sheet's low friction surface. The carer pulls or pushes the prone person effortlessly on the low friction surface with soft motions, see FIG. 22.

3. The side parts of the low friction bed sheet are tucked carefully under the mattress. A normal draw sheet is placed on top of the low friction bed sheet. The significantly reduced friction helps the carer to turn or move the person in the bed by calmly and softly pulling the draw sheet toward himself/herself, see FIG. 23.

The low friction bed sheet by itself should not be used as a draw sheet and the low friction surface should not be placed downwards toward the bed. Otherwise the low friction surface can end up on one of the edges of the bed increasing the risk of an accident.

I claim:

1. A bed sheet adapted for being used on a bed having a bed width and a bed side and for facilitating a change of a position of at least a portion of a person laying in a prone position on an upper side of the bed sheet, the bed sheet comprising:

the upper side comprising a low friction surface made of a low friction material having a first coefficient of friction, the low friction surface having a first and a second longitudinal edge portion, the low friction surface having a width that is substantially less than the bed width;

the upper side further comprising a high friction surface made of a high friction material having a second coefficient of friction, the second coefficient of friction being greater than the first coefficient of friction, the high friction surface being in operative engagement with the first longitudinal edge portion of the low friction surface;

an under side comprising the high friction material, the under side facing the bed;

a transition zone disposed along the longitudinal edge portion of the low friction surface on the upper side to indicate to the person laying in the prone position that the person is close to the bed side, the low friction surface and the high friction surface consisting of different cloths that are attached to one another to form a distinct edge therebetween to form the transition zone;

a liquid absorbing layer disposed below the upper side: and a moisture barrier disposed between the liquid absorbing layer and the under side.

2. The bed sheet according to claim 1 wherein the high friction surface material consists of a cotton-synthetic fiber mixture having a cotton content of about 0–70% by weight.

3. The bed sheet according to claim 1 wherein the transition zone is a protruding longitudinal edge portion.

4. The bed sheet according to claim 1 wherein the low friction surface is integral with the high friction surface.

5. The bed sheet according to claim 1 wherein the bed sheet comprises fasteners attached to a longitudinal side of the bed sheet.

6. The bed sheet according to claim 5 wherein the fasteners are elongate tape members adapted to attach the bed sheet to the bed.

7. The bed sheet according to claim 1 wherein the absorbent layer is adapted to cover the low friction surface and the bed sheet defines a pocket adapted to receive the absorbent layer.

8. A bed sheet adapted for being used on a bed having a bed width and a bed side and for facilitating a change of a position of at least a portion of a person laying in a prone position on an upper side of the bed sheet, the bed sheet comprising:

the upper side comprising a low friction surface made of a low friction material having a first coefficient of friction, the low friction surface having a first and a second longitudinal edge portion, the low friction surface having a width that is substantially less than the bed width; the low friction material being made of a polyester material that is washable at a bacteria killing temperature of at least 700 Celsius;

the upper side further comprising a high friction surface made of a high friction material having a second coefficient of friction, the second coefficient of friction being greater than the first coefficient of friction, the high friction surface being in operative engagement with the first longitudinal edge portion of the low friction surface;

an under side comprising the high friction material, the under side facing the bed;

a transition zone disposed along the longitudinal edge portion of the low friction surface on the upper side to indicate to the person laying in the prone position that the person is close to the bed side, the low friction surface and the high friction surface consisting of different cloths that are attached to one another to form a distinct edge therebetween to form the transition zone; and the low friction surface being surrounded by the high friction surface, the bed sheet further comprising a liquid transporting layer disposed below the upper side, a pressure relieving layer disposed below the liquid transporting layer, a liquid absorbing layer disposed below the pressure relieving layer and a moisture barrier layer disposed between the liquid absorbing layer and the under side of the bed sheet.

9. The bed sheet according to claim 8 wherein the low friction surface is attached to an absorbent layer by a plurality of seams extending across the absorbent layer.

10. The bed sheet according to claim 8 wherein the bed sheet is a disposable paper material.

11. The bed sheet according to claim 8 wherein the bed sheet is a disposable non-woven material.

12. The bed sheet according to claim 8 wherein the low friction surface is a woven sheet cloth.

13. The bed sheet according to claim 8 wherein the high friction surface material consists of a preshrunk material having a cotton content that is higher than the cotton content of the cotton-synthetic fiber mixture.

14. The bed sheet according to claim 8 wherein the low friction surface is attached to the high friction surface by a plurality of seams extending across the high friction surface.

15. A bed sheet adapted for being used on a bed having a bed width and a bed side and for facilitating a change of a position of at least a portion of a person laying in a prone position on an upper side of the bed sheet, the bed sheet comprising:

the upper side comprising a low friction surface made of a low friction material having a first coefficient of friction, the low friction surface having a first and a second longitudinal edge portion, the low friction surface having a width that is substantially less than the bed width; the low friction material being made of a polyester material that is washable at a bacteria killing temperature of at least 700 Celsius;

the upper side further comprising a high friction surface made of a high friction material having a second coefficient of friction, the second coefficient of friction being greater than the first coefficient of friction, the high friction surface being in operative engagement with the first longitudinal edge portion of the low friction surface;

an under side comprising the high friction material, the under side facing the bed;

a transition zone disposed along the longitudinal edge portion of the low friction surface on the upper side to indicate to the person laying in the prone position that the person is close to the bed side, the low friction surface and the high friction surface consisting of different cloths that are attached to one another to form a distinct edge therebetween to form the transition zone; and the low friction surface being surrounded by the high friction surface, the bed sheet further comprising a liquid absorbing layer disposed below pressure relieving layer and a moisture barrier layer disposed between the liquid absorbing layer and the under side of the bed sheet.

16. A method for changing a position of a person laying in a prone position on an upper side of a bed sheet placed on a bed having a bed side, comprising the steps of:

providing a bed sheet having an upper side comprising a low friction surface made of a low friction material having a first coefficient of friction, the low friction surface having a first and a second longitudinal edge portion, the low friction surface having a width that is substantially less than a bed width of the bed, the upper side further comprising a high friction surface made of a high friction material having a second coefficient of friction, the second coefficient of friction being greater than the first coefficient of friction, the high friction surface being in operative engagement with the first longitudinal edge portion of the low friction surface, the bed sheet further comprising an under side comprising the high friction material, the under side facing the bed, and a transition zone disposed along the longitudinal edge portion of the low friction surface on the upper side to indicate to the person laying in the prone position that the person is close to a bed side, the low friction surface and the high friction surface consisting of different cloths that are attached to one another to form a distinct edge therebetween to form the transition zone;

placing the person in the prone position on the low friction surface of the bed sheet;

placing a second sheet between the person in the prone position and the low friction surface; and shifting the second sheet on the low friction surface to move the person in the prone position relative to the bed sheet.

17. The method according to claim 16 wherein the method further comprises the step of tucking the high friction surface under the bed.

* * * * *